United States Patent [19]

Tsuchiya

[11] Patent Number: 4,944,533

[45] Date of Patent: Jul. 31, 1990

[54] FORGING-BY-COPYING-PROOF PRINTS

[75] Inventor: Shohei Tsuchiya, Tokyo, Japan

[73] Assignee: Hosokawa Printing Co., Ltd., Tokyo, Japan

[21] Appl. No.: 262,500

[22] Filed: Oct. 18, 1988

Related U.S. Application Data

[63] Continuation-in-part of Ser. No. 897,373, Aug. 18, 1986, Pat. No. 4,780,397.

[51] Int. Cl.[5] ..... B42D 15/00

[52] U.S. Cl. ..... 283/93; 430/10; 430/394; 430/396; 430/494; 283/67; 283/74; 283/902; 101/450.1; 101/468

[58] Field of Search ..... 430/10, 394, 396, 494, 430/952; 283/113, 74, 57, 902, 67, 93, 58, 59; 101/468, 450.1

*Primary Examiner*—Jose Dees
*Assistant Examiner*—J. Weddington
*Attorney, Agent, or Firm*—Wenderoth, Lind & Ponack

[57] ABSTRACT

There is provided a process for preparing a film positive sheet for a forging-by-copying-proof print in which a first background image sheet is placed on a first latent image sheet, an unexposed film having a photosensitive membrane on the undersurface is placed on the background sheet to provide a primary three-layer film structure, the three-layer film structure is illuminated to partially expose the film, the first latent image and background sheets are replaced by second latent image and second background sheets, respectively, to provide a secondary three-layer film structure, the secondary three-layer film structure is illuminated to completely expose the partially exposed film and the second latent image and background sheets are removed from the secondary three-layer structure to thereby provide a film positive sheet for a forging-by-copying-proof print. Then, a forging-by-copying-proof print is prepared from the film positive sheet by a printing method such as offset or relief printing.

6 Claims, 4 Drawing Sheets

FORGING-BY-COPYING-PROOF PRINTS

BACKGROUND OF THE INVENTION

This application is a Continuation-in-Part of Ser. No. 06/897,373, entitled "Process for Preparing Film Positive Sheets for Forging-By-Copying-Proof Prints and Prints Therefrom", filed Aug. 18, 1986, and now U.S. Pat. No. 4,780,397. The invention relates to a forging-by-copying proof print, and to a process for preparing film positive sheets and more particularly, to a process for preparing film positive sheets for prints bearing latent images which are normally invisible to the naked eye, but which are developed and visible on copies of the forging-by-copying-proof prints made from the film positive sheets whereby abuse of the prints such as forging or altering thereof by copying machines can be prevented.

In order to prevent that important documents such as securities and secret documents are copied with intention of abuse, it has been proposed that warning marks such as "VOID" and the like that are invisible to the naked eye be previously printed on the documents, yet distinguishable from the surrounding background when the documents are copied.

One proposal to date for attaining the above-mentioned purpose is a document in which the background is formed of fine meshes of a given size, and the warning mark is formed of meshes of a size different from that of the meshes forming the background. Each of the background and warning mark has a camouflage pattern incorporated therein so that the background and warning mark cannot be easily distinguished from each other with the naked eye.

Such prior art is disclosed in U.S. patent application Ser. No. 798,219 filed May 18, 1977. Although the prior art provides the effect that the incorporation of the camouflage pattern in the warning mark makes it difficult to notice the presence of the warning mark with the naked eye, the prior art has not been widely applied because of the disadvantages which will be described hereinbelow.

First of all, the prior art is disadvantageous in that when the document is copied, the warning mark cannot be clearly noted on the obtained copy. That is, as the background and warning mark in the document are formed of circular meshes, it is necessary that one of the background and warning mark be formed of meshes having a given size and the other of the background and warning mark be formed of meshes having a size different from that of the meshes forming the former. However, when the difference in mesh size is extremely great, even if the background and warning mark have camouflage patterns incorporated therein, there is the possibility that the warning mark may be identified by the naked eye. Thus, it has been contemplated that the meshes forming one of the background and warning mark be made larger than those forming the other of the background and warning mark in such a size relationship that the size of the larger meshes is a multiple of that of the smaller meshes whereby when the document is copied by a copying machine, the larger meshes are reproduced, but the smaller meshes are not reproduced in the obtained copy. However, with the multiple mesh size relationship between the larger and smaller size meshes, the size difference will not appear distinctly on the copy obtained from the document. Especially, because with rapid development of copying machine technology, the copy color adjusting range has been increased and presents the problem that the background and warning mark will be reproduced on document copies in substantially the same color tone.

And in the prior art described above, because the camouflage patterns as well as the background and warning mark are printed by a single screen, the camouflage patterns, warning mark and background lie in the same plane and do not exhibit any random appearance having decorative effects. Thus, prints or documents sometime have undesirable appearances and are not practical.

More particularly, examples of prior art patents include the following.

U.S. Pat. No. 4,351,547

The prior art of this patent is a copy-proof document in which the background 1–12 is composed of dots 2–12 and the cancellation phrase 1–10 is composed of dots 2–10 larger than the dots of the background 1–10. Interposed between the dots of the cancellation phrase 1–10 are dots 3–16 which are smaller than the dots of the background. The document of this patent is substantially similar to that of U.S. Pat. No. 4,265,460 in that the cancellation phrase is incorporated in the background, but the document of U.S. Pat. No. 4,351,547 is different from the document of U.S. Pat. No. 4,265,469 in that the small dots are interposed between the large dots.

However, when the document is copied, the document of this patent presents the problem that the cancellation phrase can not be seen and is inferior to the document of U.S. Pat. No. 4,265,469.

U.S. Pat. No. 4,341,404

The copy-proof document of this patent comprises a warning phrase 10, a background 11 and a camouflage pattern 12 on a substrate, and is substantially similar to the prior art of U.S. Pat. No. 4,265,469. The elements of the warning phrase 10 are large circles having small non-printed areas therein. The provision of the small non-printed areas within the circles makes the warning phrase invisible, but the circles which are the elements of the warning phrase themselves are very small, and when the document is printed, the small unprinted areas are not visible. Thus, the document of this patent is less practicable.

U.S. Pat. No. 4,310,180

The prior art of this patent is a so-called three-stage process for preparing a copy-proof document which comprises the steps of applying a warning phrase composed of reproducible dots to a substrate, applying a background composed of reproducible dots to the substrate, and finally applying a camouflage pattern to the substrate. On the other hand, when the film positive sheet produced by Applicant's instant invention is employed, the print can be obtained in one step and is advantageous over the cited prior art.

U.S. Pat. No. 4,265,469

This cited reference is the prior art device, described on Page 1, Line 20—Page 3, Line 23 of the instant application. The problems inherent in the prior art are stated there. Applicant's instant application discloses in detail the process for preparing a film positive sheet from which forging-by-copying-proof prints which are superior to the protected documents obtainable by the prior art are produced. By the use of the film positive sheet prepared by Applicant's process, a latent image or images which are quite different from those obtainable by the prior art with respect to the operative effect are formed. Thus, Applicant's process solves the problems inherent in the prior art, and is substantially different from the prior art.

U.S. Pat. No. 4,227,720

The document of the prior art of this patent comprises the warning phrase 10, the background screen 11 and the camouflage pattern 12 and is similar to the first prior art of U.S. Pat. No. 4,265,469. However, the color of the background is limited to pink and brown and thus, unsuitable for a white-black copier.

U.S. Pat. No. 4,210,346

Although the prior art of this patent is similar to the prior art of U.S. Pat. No. 4,265,469 in that this prior art provides a security document comprising a substrate and a security background 11 printed on the substrate and comprising a warning mark 10 composed of large and small dots which form a camouflage pattern 12, the former is different from the latter in that the watermark 20 is printed on the reverse side of the substrate. The watermark 20 does not function as copying-proof means, but simply verifies that the document is a genuine document. Thus, the surface of the substrate of this prior art is within the technological scope of U.S. Pat. No. 4,265,469.

U.S. Pat. No. 4,175,774

The invention of this patent is directed to a document in which larger dots 22 are reproduced by a copier and smaller dots 24 are not reproduced by the copier and thus, the document of this invention is substantially similar to the document of U.S. Pat. No. 4,265,469. However, as the document of this patent is not provided with means for hiding the difference between the sizes of the larger and smaller dots, when viewed with naked eye, the document has the drawback that the indicia 28 is seen and thus seems inferior to the document of U.S. Pat. No. 4,265,469.

U.S. Pat. No. 4,168,088

The prior art of this patent is directed to a document in which the printed matter 40 of intermediate size is present between the warning term 20 and the background matter 30, and makes the warning term invisible to the naked eye. However, when the intermediate size printed matter is provided, even after the copying of the document, the warning term and background matter can not be clearly distinguished from each other. As a result, the provision of the warning term is meaningless.

U.S. Pat. No. 3,675,948

The invention of this patent is not directed to the prevention of forging of a document by a copier, but provides a method for printing a hidden image in such a manner that whether a print of the document is genuine or not can be detected.

U.S. Pat. No. 1,002,600

The invention of this patent is directed to means for detecting a particular document on which a phrase or pattern and a background are printed in the form of parallel lines at different angles by the use of a special detector. That is, the invention of this patent has as its principal object to identify a document having the phrase and/or pattern printed thereon as genuine when the phrase and/or pattern can be seen by a special detection means. Thus, the invention of this patent has nothing to do with a copy-proofing function and is substantially different from Applicant's instant invention.

It is clear that the above mentioned disadvantages result from processes for preparing film positive sheets from which prints or documents are prepared.

SUMMARY OF THE INVENTION

According to one aspect of the present invention, there is provided a process for preparing a film positive sheet for a forging-by-copying-proof print which comprises the steps of providing a latent image negative, placing a multi-line negative on the upper surface of said latent image negative, placing an unexposed film having a photosensitive membrane on the undersurface thereof on the upper surface of said multi-line negative to provide a primary three-layer film structure, striking light from a light source against the undersurface of said primary three-layer film structure to partially expose said unexposed film so as to form a primary film positive sheet, replacing said latent image negative by a latent image positive and said multi-line negative by a mesh negative, respectively, to form a secondary three-layer film structure, striking light from said light source against the undersurface of said secondary three-layer film structure to completely expose said partially exposed film and removing said latent image positive and mesh negative from said secondary three-layer film structure to thereby provide a film positive sheet for a forging-by-copying-proof print. A forging-by-copying-proof print is then prepared from the film positive sheet.

According to another aspect of the present invention, there is provided a process for preparing a film positive sheet for a forging-by-copying-proof print which comprises the steps of providing a latent image positive, placing a multi-line negative on the upper surface of said latent image positive, placing an unexposed film having a photosensitive membrane on the undersurface thereof on the upper surface of said multi-line negative to form a primary three-layer film structure, striking light from said light source against the undersurface of said primary three-layer film structure to partially expose said film to provide a primary film positive sheet, replacing said latent image positive by a latent image negative and said multi-line negative by a mesh negative, respectively, to form a secondary three-layer film structure, striking light from said light source against the undersurface of said secondary three-layer film structure to completely expose said partially exposed film and removing said latent image and mesh negative from said secondary three-layer film structure to thereby provide a film positive sheet for a forging-by-copying-proof print. A forging-by-copying-proof print is then prepared from the film positive sheet.

The above and other objects and attendant advantages of the present invention will be more readily apparent to those skilled in the art from a reading of the following detailed description in conjunction with the accompanying drawings which show preferred embodiments of the invention for illustration purpose only, but not for limiting the scope of the same in any way.

PREFERRED EMBODIMENTS OF THE INVENTION

The present invention will be now described referring to the accompanying drawings which show one preferred embodiment of the present invention for illustration purpose.

Figure 1:
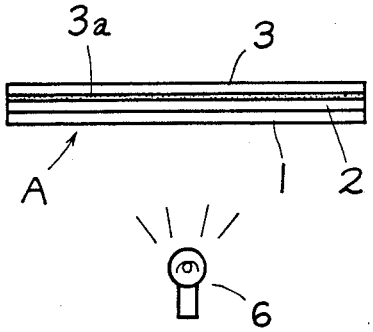
FIG. 1 is a side elevational view showing a first exposure step in the process according to the present invention.
Figure 2:
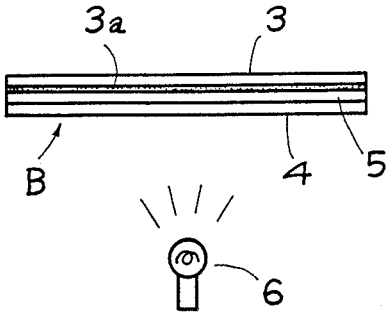
FIG. 2 is a side elevational view showing a second exposure step in the process according to the present invention.
Figure 3:
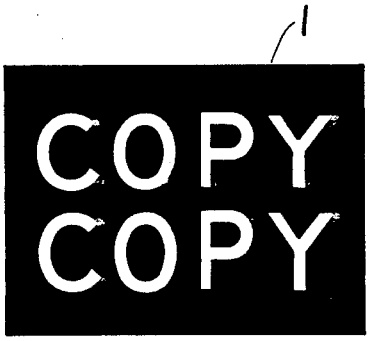
FIG. 3 is a plan view of a latent image negative employed in the process according to the present invention.
Figure 7:
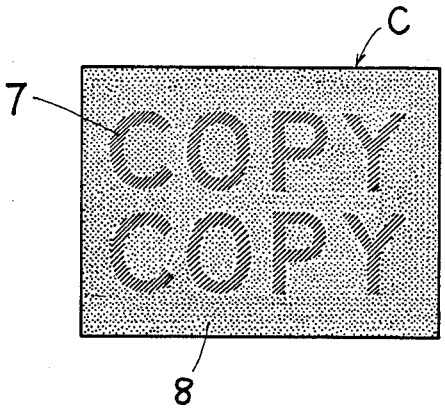
FIG. 7 is a plan view of a film positive sheet produced by the process according to the present invention.
Figure 8:
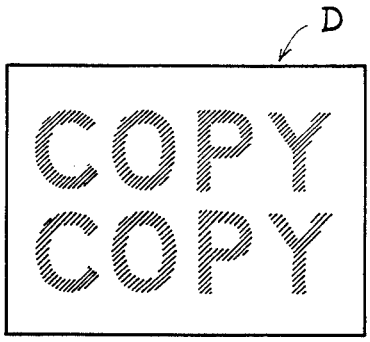
FIG. 8 is a plan view of a copy of a print prepared by the employment of the film positive sheet as shown in FIG. 7.

In FIG. 1, reference numeral 1 denotes a latent image negative having two blank "COPY" images surrounded by the black background thereon and a multi-line negative 2 is placed on the upper surface of the latent image negative 1 and has 50 (fifty) lines extending at 45° with respect to the longitudinal axis of the negative covering 90% of the area of the negative. An unexposed film 3 having a photosensitive membrane 3*a* on the undersurface is placed on the upper surface of the multi-line negative 2 to thereby provide a primary three-layer film structure A. In a first exposure step in the process according to the present invention, a light source 6 is energized to strike light against the undersurface of the primary three-layer film structure A to partially expose the photosensitive membrane 3*a* whereupon the two blank "COPY" images on the latent image negative 1 are developed on the photosensitive membrane 3*a* as multi-line images of 50-line 10% area. Furthermore, after the first exposure step, the latent image negative 1 of the primary three-layer film structure A is replaced by a latent image positive 4 and the multi-line negative 2 is replaced by a mesh negative 5 of 150-line 90% area, respectively, to provide a secondary three-layer film structure B. Thereafter, the light source 6 is again energized to strike light against the undersurface of the secondary three-layer film structure B in the same manner as the first exposure step to completely expose the photosensitive membrane 3*a* whereupon meshes of 150-line 10% area are developed in the region of the photosensitive membrane 3*a* of the film 3 other than the region where the two multi-line "COPY" images were developed in the first exposure step whereby a film positive sheet C having the multi-line latent images 7 and the mesh background 8 as shown in FIG. 7 is obtained. When printing is performed on a sheet of paper employing the film positive sheet C, the latent image consisting of 50-line 10% area and the background consisting of 150-line 10% area are formed on the sheet of paper. When the thus printed sheet of paper is copied by a copying machine, as shown in FIG. 8, the multi-lines are reproduced in deep color on the copy D, but the meshes are not reproduced on the copy and thus the two "COPY" images can be clearly seen.

Figure 9:
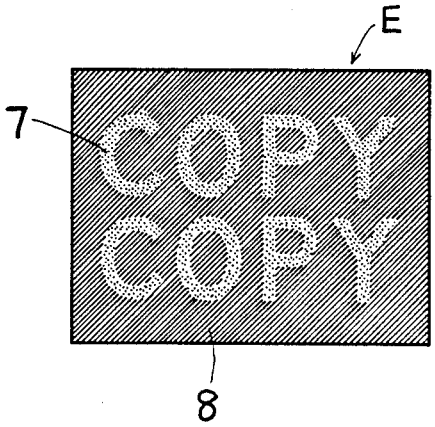
FIGS. 9 and 10 are plan views of film positive sheets produced by the process according to the present invention.

When the latent image negative 1 in the primary three-layer film structure A is replaced by the latent image positive 4 and the modified three-layer film structure is subjected to the first exposure and the latent image positive 4 in the secondary three-layer film structure B is replaced by the latent image negative 1 and the resulting three-layer film structure is subjected to the second exposure, the film positive sheet E as shown in FIG. 9 is obtained. That is, by reversing the operation procedure in the embodiment described above, the latent images 7 are formed of meshes of 150-line 10% area and the background 8 is formed of multi-lines of 50-line 10% area. Thus, when a print prepared by the film positive sheet E is copied by a copying machine, the meshes are not reproduced on the obtained copy, but the multi-lines are reproduced in deep color on the copy and thus, the blank "COPY"0 images can be clearly seen.

Figure 4:
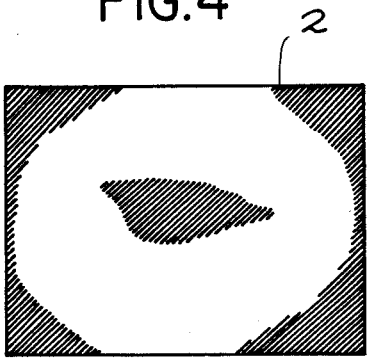
FIG. 4 is a plan view of a multi-line negative employed in the process according to the present invention.
Figure 5:
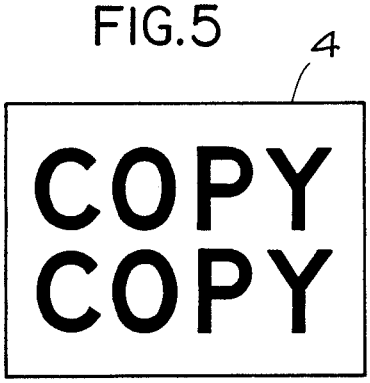
FIG. 5 is a plan view of a latent image positive employed in the process according to the present invention.
Figure 6:
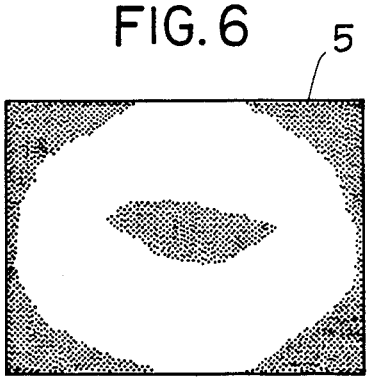
FIG. 6 is a plan view of a mesh negative employed in the process according to the present invention.
Figure 10:
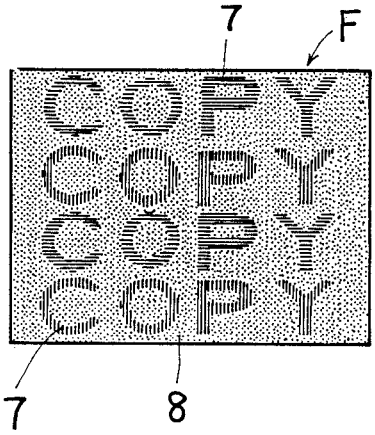
Figure 11:
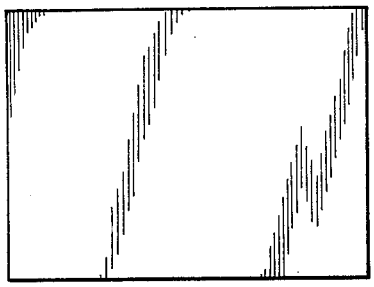
FIG. 11 is a plan view of a print prepared by the employment of the film positive sheet according to the present invention.
Figure 12:
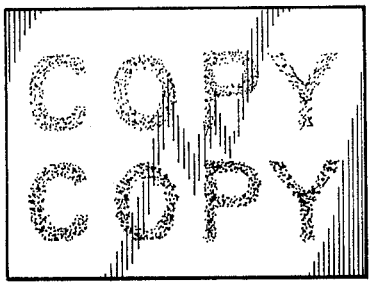
FIG. 12 is a somewhat schematic plan view of a photocopy of the print of FIG. 11 showing the kind of reproduction that would result from an attempt to copy a print made according to the present invention.
Figure 13A:
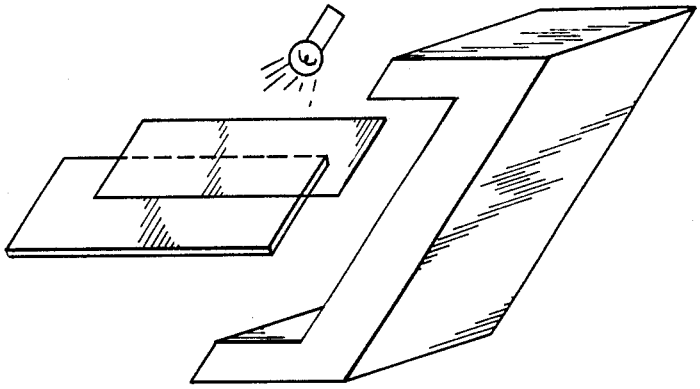
FIG. 13A is a somewhat schematic representation of the process in which a positive film sheet is placed on an offset positive presensitized (PS) plate and the positive film sheet and offset positive PS plate are caused to adhere closely to each other in a vacuum frame. The stacked film sheet and PS plate are exposed by light rays from an ultraviolet light source.
Figure 13B:
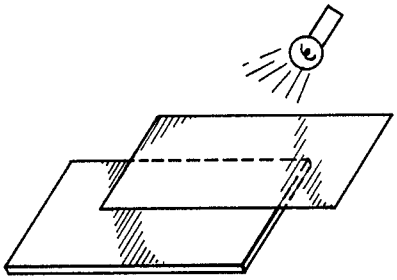
FIG. 13B is a somewhat schematic representation of the process in which a negative film sheet is prepared from the positive film sheet of FIG. 13A. The light source is not necessarily an ultraviolet light source.
Figure 13C:
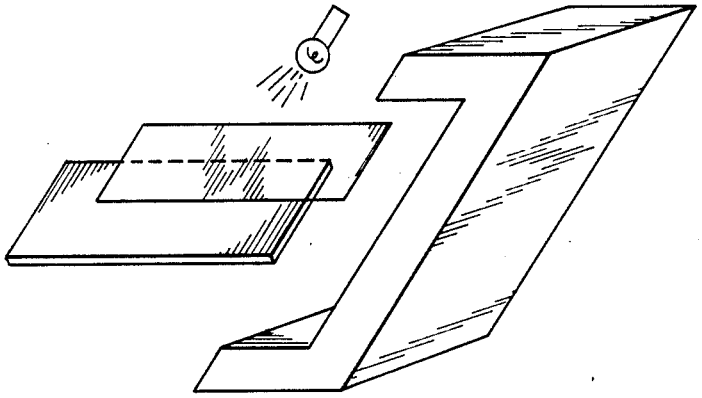
FIG. 13C is a somewhat schematic representation of the process in which the negative film sheet prepared by the process of FIG. 13B is placed on a sensitive resin relief printing plate and the negative film sheet and sensitive resin relief printing plate are caused to adhere closely to each other in a vacuum printing frame. The stacked negative film sheet and sensitive resin relief printing plate are exposed by light rays from a light source. The light source is not necessarily an ultraviolet light source.

The inclination of the lines on the multi-line negative 2 may be 90° or parallel to the longitudinal axis of the negative other than 45° as shown in FIG. 4 depending upon the direction of light emitting from the copying machine and, furthermore, when the latent images 7 appear in multi-lines at a greater number of areas, the film positive sheet is preferably produced as comprising a combination of multi-lines extending at 90° and parallel to the longitudinal axis of the sheet as more clearly shown in FIG. 10.

The process of the present invention provides the following particular effects:

A. As the multi-line negative 2 and the mesh negative 5 are employed in the preparation of a film positive sheet, the latent images 7 and background 8 are formed in multi-lines and meshes, respectively, on the obtained film positive sheet. Thus, a print prepared by the employment of the film positive sheet similarly comprises the combination of multi-lines and meshes and when a print is prepared by the employment of the film positive sheet and the print is copied, the background and latent images on the obtained copy can be clearly distinguished from each other, and even when the light intensity of the copying machine is varied, there is no possibility that the boundary between the background and latent images becomes obscured. In other words, because the mesh negative 5 has about 150 lines covering the area on the order of 90% thereof, the lines are not reproduced by the ordinary light intensity of the copying machine, thus leaving the mesh negative 5 blank. On the other hand, because the multi-line negative has about 50 lines covering the area on the order of 90% of the negative, the lines on the negative can be reproduced in deep color by a conventional copying machine with the normal light intensity of the machine and regardless of variation in the light intensity of the machine. This is owing to the phenomena that the multi-lines are printed in a continuous pattern different from the meshes and that the multi-lines have the adaptability to the light emitting direction of the copying machine (i.e., the physical properties of the multi-lines are responsive regardless of the direction of light).

B. The film positive sheet, such as shown in FIGS. 7, 9, and 10, comprises the latent images 7 formed of multi-lines and the background 8 formed of meshes, and thus, the surfaces of a print prepared by the employment of the film positive sheet are smooth and present a decent appearance. Furthermore, the presence of the latent images on the print cannot be seen with the naked eye. In short, because the multi-lines are irregular in length in conformity with the contours of the latent images, the multi-lines have an effect which dazzles the naked eye and thus, the latent images are not seen even when no camouflage pattern is incorporated in the film positive sheet.

C. When the inclination angle of the lines on the multi-line negative 2 is 45° with respect to the longitudinal axis of the negative and placed on a duplicator, even if an article to be printed is set in any orientation on the duplicator, the lines on the multi-line negative 2 can be reproduced having the same depth on the obtained print. Alternatively, when the lines on the multi-line negative 2 are orientated at 90° or parallel to the longitudinal axis of the negative, the lines extending in the direction in conformity with the light emitting direction of the duplicator can be more clearly reproduced on the obtained print.

As more clearly shown in FIG. 10, when a greater number of latent images 7 are provided on the latent image negative 1, if the lines on the multi-line negative 2 are orientated in a combination of 90° and parallel to the longitudinal axis of the multi-lines negative 2, the latent images in multi-lines in the direction in conformity with the light emitting direction of the duplicator or copying machine are conspicuously reproduced on an article to be printed regardless of the orientation of the article to be printed on the copying machine.

D. As mentioned hereinabove, when a copy is made from the print prepared by employing the film positive sheet embodying the present invention, the copy has the latent images quite clearly developed as positive images thereon, and thus, when a light color pattern which is not easily reproduced is printed over the latent image, although the pattern is faintly reproduced on a copy of the overprinted product, the latent image is fully visible. Thus, there is a practical advantage that a print having a decorative pattern thereon can be obtained. And even when the film positive sheet prepared by the process according to the present invention has a camouflage pattern incorporated therein, the latent image or images on a copy obtained by a copying machine employing the film positive sheet can be more clearly developed, as compared with the latent images on copies obtained employing film positive sheets prepared by conventional processes, and the incorporation of the camouflage pattern into the film positive sheet is also within the scope of the present invention.

The processes for preparing the forging-by-copying-proof prints from the film positive sheet of the present invention are as follows:

1. Offset Printing:

An offset positive PS plate (presensitized plate) having an ultraviolet-light-sensitive layer on one surface is provided with the sensitive layer on the top and the inventive film positive sheet having an ultraviolet-light-sensitive layer on one surface is placed on the offset positive PS plate with the sensitive layers on the PS plate and on the film positive sheet in close contact. The stacked plate and film sheet are placed in a vacuum printing frame to cause them to contact closely each other and are exposed by light rays from an ultraviolet light source. After the exposure the film positive sheet is removed from the PS plate and the plate is subjected to surface treatment using a suitable chemical to produce a printing plate. Then, the printing plate is set on an offset printing machine to produce forging-by-copying-proof prints by a known offset printing method.

2. Relief Printing:

A negative film having a light sensitive layer on one surface and bearing a positive image as seen from the side of the sensitive layer is prepared from the inventive film positive sheet by the close contact process. The close contact process involves contact induced by a vacuum frame. (When sheets are placed one upon another, they merely contact closely each other whereas when the sheets are placed into a vacuum frame, they are caused to adhere closely each other).

Then, the negative film is separated from the film positive sheet and placed on a light sensitive resin relief printing plate having a light sensitive layer on one surface to bring the sensitive layers on the negative film sheet and light sensitive resin relief printing plate into close contact. The stacked negative film sheet and relief printing plate are subjected to vacuum printing treatment and then to a known light sensitive layer treatment , such as exposure to light rays from a light source, followed by separation of the negative film sheet from the light sensitive relief resin plate which becomes a resin relief printing plate. The resin relief printing plate is set on a relief printing machine to obtain forging-by-copying-proof prints by a known relief printing method.

While preferred embodiments of the invention have been shown and described in detail, it will be understood that the same are for illustration purposes only and not to be taken as a definition of the scope of the invention, which scope is defined by the appended claims.

I claim:

1. A process for preparing a forging-by-copying-proof print comprising the steps of first preparing a film positive sheet for a forging-by-copying-proof print, the preparing of the film positive sheet including the steps of providing a latent image negative, placing a multi-line negative on the upper surface of said latent image negative, placing an unexposed film having a photosensitive membrane on the undersurface thereof on the upper surface of said multi-line negative to form a primary three-layer film structure, striking light from a light source against the undersurface of said primary three-layer film structure to partially expose said unexposed film so as to provide a primary film positive sheet, replacing said latent image negative by a latent image positive and said multi-line negative by a mesh negative, respectively, to form a secondary three-layer film structure, striking light from said light source against the undersurface of said secondary three-layer film structure to completely expose said partially exposed film and removing said latent image positive and mesh negative from said secondary three-layer film structure to thereby provide a film positive sheet for a forging-by-copying-proof print for use in the following step, and then preparing a forging-by-copying-proof print from the film positive sheet by an offset or relief printing method.

2. A forging-by-copying-proof print prepared by the process as set forth in claim 1.

3. A process for preparing a forging-by-copying-proof print comprising the steps of first preparing a film positive sheet for a forging-by-copying-proof print, the preparing of the film positive sheet including the steps of providing a latent image positive, placing a multi-line negative on the upper surface of said latent image positive, placing an unexposed film having a photosensitive membrane on the undersurface thereof on the upper surface of said multi-line negative to form a primary three-layer film structure, striking light from a light source against the undersurface of said primary three-layer film structure to partially expose said unexposed film to provide a primary film positive sheet, replacing said latent image positive by a latent image negative and said multi-line negative by a mesh negative, respectively, to form a secondary three-layer film structure, striking light from said light source against the undersurface of said secondary three-layer film structure to completely expose said partially exposed film and removing said latent image and mesh negatives from said secondary three-layer film structure to thereby provide a film positive sheet for a forging-by-copying-proof print for use in the following step, and then preparing a forging-by-copying-proof print from the film positive sheet by an offset or relief printing method.

4. A forging-by-copying-proof print prepared by the process as set forth in claim 3.

5. A process for preparing a forging-by-copying-proof print comprising the steps of first preparing a film positive sheet for a forging-by-copying-proof print, the preparing of the film positive sheet including the steps of providing a latent image negative, placing a multi-line negative on the upper surface of said latent image negative, placing an unexposed film having a photosensitive membrane on the undersurface thereof on the upper surface of said multi-line negative to form a primary three-layer film structure, striking light from a light source against the undersurface of said primary three-layer film structure to partially expose said unexposed film so as to provide a primary film positive sheet, replacing said latent image negative by a latent image positive and said multi-line negative by a mesh negative, respectively, to form a secondary three-layer film structure, striking light from said light source against the undersurface of said secondary three-layer film structure to completely expose said partially exposed film and removing said latent image positive and mesh negative from said secondary three-layer film structure, and providing an ultraviolet-light sensitive layer on one surface thereof to thereby provide a film positive sheet for a forging-by-copying-proof print for use in the following step, placing an offset positive PS plate (a predetermined plate) having an ultraviolet-light-sensitive layer on one surface and the film positive sheet of the previous step one upon another with the ultraviolet-light sensitive layers in contact, causing the stacked positive PS plate and the film positive sheet to adhere closely to each other in a vacuum printing frame, exposing the stacked positive PS plate and film positive sheet by light rays from an ultraviolet light source, separating the film positive sheet from the PS plate, subjecting the PS plate to surface treatment by use of a suitable chemical for forming a printing plate, setting the surface treated printing plate on an offset printing machine for preparing a print therefrom by an offset printing method, and obtaining a print by offset printing.

6. A process for preparing a forging-by-copying-proof print comprising the steps of first preparing a film positive sheet for a forging-by-copying-proof print, the preparing of the film positive sheet including the steps of providing a latent image positive, placing a multi-line negative on the upper surface of said latent image positive, placing an unexposed film having a photosensitive membrane on the undersurface thereof on the upper surface of said multi-line negative to form a primary three-layer film structure, striking light from a light source against the undersurface of said primary three-layer film structure to partially expose said unexposed film to provide a primary film positive sheet, replacing said latent image positive by a latent image negative and said multi-line negative by a mesh negative, respectively, to form a secondary three-layer film structure, striking light from said light source against the undersurface of said secondary three-layer film structure to completely expose said partially exposed film and removing said latent image and mesh negatives from said secondary three-layer film structure to thereby provide a film positive sheet for a forging-by-copying-proof print for use in the following step, providing a negative film having a light sensitive layer thereon, preparing a prepared negative film sheet bearing a positive image as seen from the side of the light sensitive layer from the film positive sheet of the previous step by closely adhering said negative film and the film positive sheet for obtaining a prepared negative film sheet with the image from said film positive sheet thereon, separating the prepared negative film sheet from the film positive sheet, positioning the prepared negative film sheet on a resin relief printing plate having a light sensitive layer with the prepared negative film sheet in close contact with the light sensitive layer of the resin relief printing plate, causing the prepared negative film sheet and resin printing plate to adhere closely in a vacuum printing frame, exposing the stacked prepared negative film sheet and relief resin printing plate by light rays from a light source, separating the prepared negative film sheet from the relief resin printing plate, subjecting the relief resin printing plate to sensitizing treatment to obtain a resin printing plate, setting the resin printing plate on a relief printing machine, and obtaining a print from the sensitized resin relief printing plate by relief printing.

* * * * *